United States Patent [19]

Klawitter

[11] 4,313,277

[45] Feb. 2, 1982

[54] FLOATABLE TOY

[75] Inventor: Ronald R. Klawitter, Hermann, Mo.

[73] Assignee: Steven Manufacturing Company, Hermann, Mo.

[21] Appl. No.: 80,388

[22] Filed: Oct. 1, 1979

[51] Int. Cl.[3] ..... A63H 23/06

[52] U.S. Cl. ..... 46/95

[58] Field of Search ..... 46/95, 93, 91, 92

[56] References Cited

U.S. PATENT DOCUMENTS

| | | | |
|---|---|---|---|
| 2,667,141 | 1/1954 | Lepkowski | 46/95 X |
| 3,307,290 | 3/1967 | Pedersen | 46/95 X |
| 3,699,709 | 10/1972 | Schmidt | 46/28 X |
| 4,045,907 | 9/1977 | Mumford | 46/93 |

FOREIGN PATENT DOCUMENTS

| | | | |
|---|---|---|---|
| 291614 | 12/1931 | Italy | 46/95 |

*Primary Examiner*—Gene Mancene
*Assistant Examiner*—Mickey Yu
*Attorney, Agent, or Firm*—Polster, Polster and Lucchesi

[57] ABSTRACT

A floatable toy (e.g., a toy boat) having two hulls, a frame spanning the hulls, and a container for holding a supply of water above the level of the water on which the toy floats. A discharge outlet is connected to the container at its bottom and extends downwardly below the surface of the water. A nozzle opening is provided at the bottom of the discharge outlet so as to discharge a jet of water in a generally horizontal direction thereby to impart thrust on the floatable toy. The container and the discharge outlet are rotatable relative to the frame spanning the hulls about a generally vertical axis so as to enable the toy to be steered.

2 Claims, 5 Drawing Figures

FLOATABLE TOY

BACKGROUND OF THE INVENTION

This invention relates to a floatable toy, and more particularly to a toy boat or the like which is propelled through the water.

More specifically, this invention is an improvement of the floatable toy disclosed in U.S. Pat. No. 4,045,907 issued Sept. 6, 1977 to Mr. Michael A. Munford of Peterborough, England. The floatable toy disclosed in the above-noted patent has a pair of spaced, closed hulls with a platform secured to the hulls at the mid portions thereof and spanning the distance between the hulls. A container is rigidly mounted on the platform above the level of the water on which the toy floats and the container has a discharge outlet which extends downwardly below the surface of the water between the spaced hulls. In operation, the container is filled with water and the head pressure of the water forces a jet of water from the discharge outlet in generally horizontal direction thereby to impart thrust to the toy boat so as to propel it through the water. In the above-noted patent, the jet of water is directed in rearward direction so as to propel the toy forward. However, the toy could only be propelled only in forward direction and could not be steered or turned.

Among the several objects and features of the present invention may be noted the provision of a floatable toy (e.g., a toy boat) which may be propelled through the water in any desired direction and which requires no motor (such as a spring-wound or battery-powered motor) and which has no moving parts;

The provision of such a floatable toy which may be readily steered;

The provision of such a floatable toy which is of rugged construction, which may be readily and inexpensively fabricated, and which is appealing to children.

Other objects and features of this invention will be in part apparent and in part pointed out hereinafter.

SUMMARY OF THE INVENTION

Briefly stated, this invention relates to a floatable toy, such as a toy boat or the like, which is propelled by means of water discharged under the force of gravity through a jet. The floatable toy includes a pair of spaced hulls, a container for holding a supply of water above the level of the water on which the floatable toy floats, and means spanning between the hulls for supporting the container. A discharge nozzle is operatively connected to the container for directing a jet of water in generally horizontal direction so as to impart thrust on the toy for propelling it through the water in a direction generally opposite to the direction of the jet. Specifically, the improvement of this invention comprises means for rotatably mounting the nozzle relative to said toy for rotation about a generally vertical axis so that the toy may be propelled in any desired direction.

BRIEF DESCRIPTION OF THE DRAWINGS

Corresponding reference characters indicate corresponding parts throughout the several views of the drawings.

DESCRIPTION OF A PREFERRED EMBODIMENT

Figure 3:
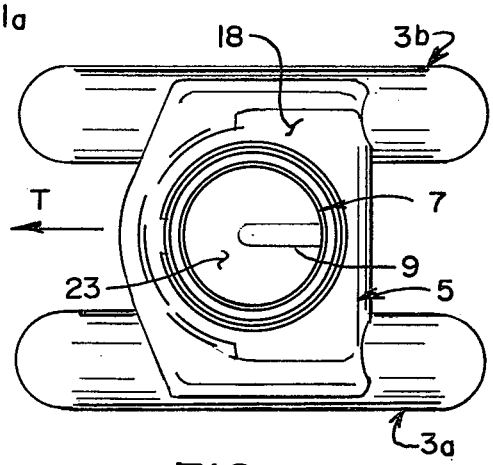
FIG. 3 is a top plan view of the toy illustrated in FIG. 2.
Figure 4:
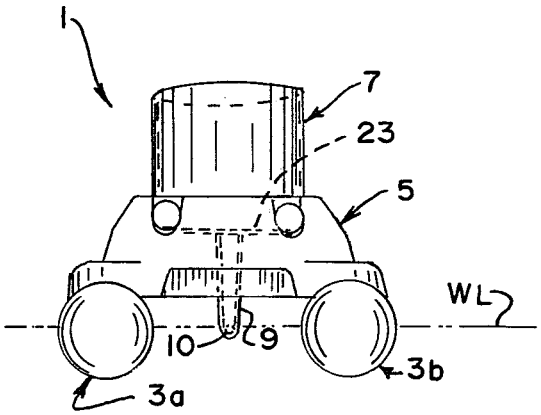
FIG. 4 is a rear elevational view.

Referring now to the drawings, a floatable toy of this invention is indicated in its entirety by reference character 1. The toy illustrated in the drawings is shown to comprise a pair of spaced hulls, as indicated generally at 3*a*, 3*b*. A support deck or frame 5 is secured (e.g., bonded) to the upper surfaces of each of the hulls and spans the distance therebetween thereby holding the hulls in desired spaced parallel relation. A container, as generally indicated at 7, is carried by support deck 5. The container has an outlet 9 which extends downwardly from the bottom thereof and, as shown in FIG. 4, extends below the surface of the water level WL on which toy 1 floats. A relatively small diameter opening 10 is provided in the discharge structure 9 for purposes as will appear. Container 7 is intended to hold a volume of water. As shown in FIG. 3, the interior of discharge structure 9 is in communication with the interior of the container whereby both the interior of the discharge structure and the container are filled with water. Discharge opening 10 is disposed in the discharge structure in such manner as to discharge a jet J of water therefrom in generally horizontal direction below the surface of the water thereby to impart a thrust vector T on floatable toy 1 in the direction opposite of jet J. Thus, the floatable toy is propelled in the direction of thrust vector T.

Figure 1:
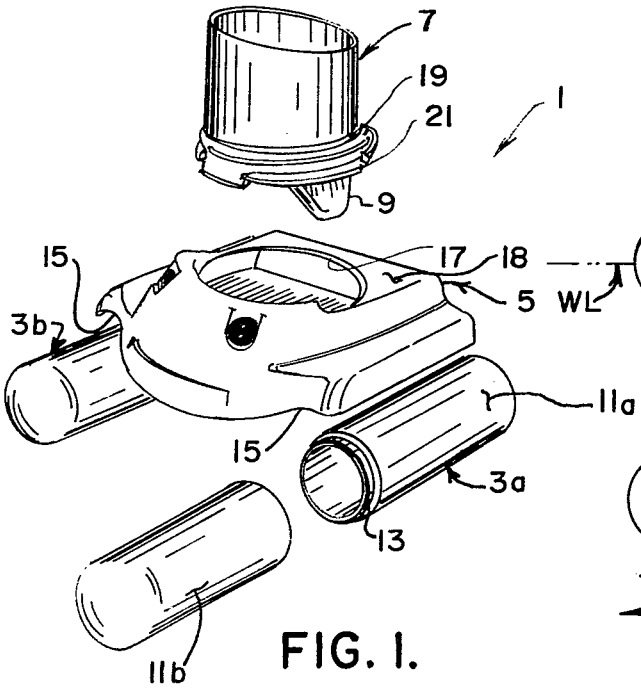
FIG. 1 is an exploded perspective view of a floatable toy of the present invention.
Figure 2:
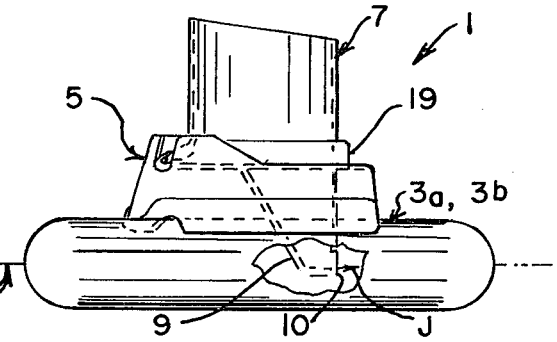
FIG. 2 is a right side elevational view of the toy illustrated in FIG. 1 with parts broken away showing a discharge nozzle disposed below the surface of the water on which the toy floats.

In the preferred embodiment of the floatable toy of this invention, all of the parts are preferably made of anyone of a number of molded synthetic resins, such as high impact polystyrene. As shown in FIG. 1, each hull 3*a*, 3*b* is formed in two parts with one of the parts, as indicated at 11*a*, having a mounting flange 13 extending endwise therefrom for fitting into the interior of a mating hull part 11*b*. The hull parts are molded with closed, part-spherical ends. Thus, when flange 13 on hull part 11*a* interfits with its mating part 11*b* and when a suitable adhesive applied to the joint between the hull parts, a water-tight, hollow floatable hull is formed. Support deck 5 is shown to be also molded of a suitable synthetic plastic material and it is provided with hull mounting surfaces 15 engageable with the tops of hulls 3*a* and 3*b*. Again, a suitable adhesive may be applied to the hull mating surfaces 15 thereby to rigidly bond the support deck to the upper sides of the spaced hulls and to securely hold the hulls in desired spaced relation.

Support deck 5 further includes an opening 17 in a generally horizontal deck surface 18 thereof, opening 17 being adapted to receive container 7. The container includes a flange 19 extending circumferentially therearound and a plurality of lugs 21 spaced in axial direction from flange 19. Lugs 21 snap fit into opening 17 with a portion of deck 18 disposed between flange 19 and lugs 21. Thus, the container 7 is positively held in rotatable position on the support deck. It will be understood that the downwardly facing side of flange 19 constitutes a bearing surface for rotatably supporting container 7 on deck 18. In this manner container 7 may be readily snap fitted into the support deck and that it is securely held in position thereon while at the same time being free to rotate about the vertical axis of opening 17.

Container 7 further includes a bottom wall 23 integral with the container and discharge structure 9 extends downwardly from the bottom wall. It will be appreciated that the discharge structure 9, bottom wall 23, and the side walls of container 7 are integrally molded of a suitable synthetic resin material and thus constitute an integral one-piece part. Also, discharge outlet 10 in discharge structure 9 is formed in the rear vertical wall of the discharge structure. As mentioned above, the size of the discharge opening is relatively small for emitting a jet of water therefrom in generally horizontal direction for imparting thrust to floatable toy 1. While the size of the discharge opening may vary considerably depending on the head height of container 7, the quantity of water contained therein, and the size of the floatable toy, the discharge opening may, for example, have a diameter of approximately $\frac{1}{8}$ inch (3.1 mm.) and container 7 may have a capacity of about 2.7 oz. (80 cc.).

Figure 5:
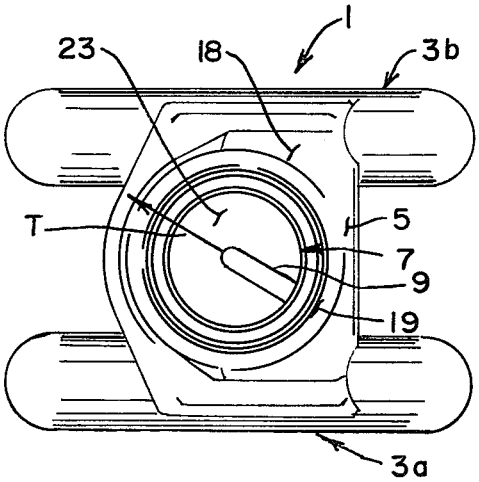
FIG. 5 is a plan view similar to FIG. 3 showing the container in a rotated position so as to direct a thrust vector toward the right side of the toy thereby to cause the toy to turn in the direction of the thrust vector.

In operation, the toy is placed on the surface of the water and container 7 is filled with water. Immediately upon filling the container, water will be discharged from opening 10 in a jet J in generally horizontal direction thereby imparting a thrust force or vector T on the toy in generally opposite direction to jet J. Of course, this thrust force will propel the toy in the direction of the thrust. In accordance with this invention, the direction of the thrust relative to the toy may be varied merely by turning container 7 relative to support deck 5 as illustrated in FIG. 5. More specifically, the one-piece structure constituting container 7, discharge structure 9 and nozzle 10 may be selectively rotated about a vertical axis coaxial with the center of opening 17 in clock 18 for steering the toy in any desired direction.

Of course, it will be understood that various surfaces of the toy may be decorated in any manner so as to impart a pleasing appearance to the toy.

It will further be understood that within the broader aspects of this invention that it would not be necessary to provide a pair of spaced parallel hulls as shown in the drawings, but rather that container 7 may be rotatably mounted on any floatable hull in such manner that its discharge outlet 9 extends below the surface of the water and such that the container may be readily rotated about a vertical axis thereby to change the direction of the thrust on the toy and to permit the toy to be steered in any desired direction.

In view of the above, it will be seen that the several objects of the invention are achieved and other advantageous results attained.

As various changes could be made in the above construction without departing from the scope of the invention, it is intended that all matter contained in the above description and shown in the accompanying drawings shall be interpreted as illustrative and not in a limiting sense.

I claim:

1. A floatable toy having a pair spaced, water-tight hollow floatable hulls extending in generally longitudinal direction relative to the toy, a support deck secured to and extending between the upper surface of said hulls above the level of the water when the toy is floating on the surface of the water, said support deck having a generally horizontal surface with an opening therein, a one-piece container having a reservoir portion for holding a supply of water above the level of the water on which the toy is floating and a discharge nozzle extending down from said reservoir portion of the container below the surface of the water, said discharge nozzle having an opening below the surface of the water for the discharge of the water contained in the reservoir portion of the container under the hydrostatic pressure of the water in the reservoir portion of the container in generally horizontal direction to impart a propelling force to said toy, said container having an integral flange extending generally circumferentially therearound and a plurality of integral lugs spaced axially below said flange, said lugs being insertable through said opening in said support deck and cooperating with said flange whereby a portion of said support deck defining said opening is held captive between said adjacent inner faces of said lugs and said flange with the inner face of said flange constituting a bearing surface permitting manual rotation from above of said container together with said nozzle relative to said support deck about a generally vertical axis whereby the propelling force may be selectively directed in any desired direction relative to said toy for steering the toy in any desired direction.

2. A toy as set forth in claim 1 wherein the junction of said container and said support deck is above the level of the water.

* * * * *